US005255480A

United States Patent [19]

Alsop

[11] Patent Number: 5,255,480

[45] Date of Patent: Oct. 26, 1993

[54] GROUND ANCHORING SYSTEM

[75] Inventor: Peter Alsop, Kent, Great Britain

[73] Assignee: Hydracor International, Inc., Alexandria, Va.

[21] Appl. No.: 752,607

[22] PCT Filed: Feb. 21, 1990

[86] PCT No.: PCT/GB90/00273

§ 371 Date: Aug. 15, 1991

§ 102(e) Date: Aug. 15, 1991

[87] PCT Pub. No.: WO90/10114

PCT Pub. Date: Sep. 7, 1990

[30] Foreign Application Priority Data

Feb. 23, 1989 [GB] United Kingdom ..... 8904169

[51] Int. Cl.[5] ..... E02D 5/74

[52] U.S. Cl. ..... 52/162; 52/154; 52/160; 52/163; 52/164

[58] Field of Search ..... 52/160, 162 OR, 163, 52/164, 153, 155, 154

[56] References Cited

U.S. PATENT DOCUMENTS

| | | | |
|---|---|---|---|
| 2,243,886 | 6/1941 | Scott | 52/160 |
| 2,366,997 | 4/1944 | Brand | 52/160 |
| 2,633,947 | 4/1953 | Schiff | 52/162 |
| 3,012,644 | 12/1961 | Bush | 52/162 |
| 3,282,002 | 11/1966 | Jefferson et al. | 52/162 |
| 3,772,838 | 11/1973 | Virnig | 52/160 |
| 3,774,361 | 11/1973 | Tanner | 52/162 |
| 4,015,433 | 4/1977 | Shibata | 52/160 |

*Primary Examiner*—Carl D. Friedman
*Assistant Examiner*—Wynn E. Wood
*Attorney, Agent, or Firm*—Lowe, Price, LeBlanc & Becker

[57] ABSTRACT

A ground anchor comprises a generally flat anchor plate folded into a U or V-shape against a resilient bias. The resilient bias may be inherent in the folded portions of the anchor plate, or may be provided by means of auxiliary or plate springs disposed between the folded portions. In the latter, a retaining pin may secure the folded portions together while driving the plate into the ground. A release arrangement shears the pin so that the plate springs open to resist subsequent extraction.

15 Claims, 4 Drawing Sheets

GROUND ANCHORING SYSTEM

This invention relates to a ground anchoring system of the type in which an object is anchored to the ground by a ground anchor secured at one end of a flexible anchor line, the other end of the line being secured to the object, and the anchor being forcibly driven into the ground by a driving tool. The system can be used underwater, for example when anchoring mats of synthetic fronds to a river or sea bed.

It is important in such a system that the anchor should resist extraction once it has been driven into the ground. For example, where the anchor is in the form of a flat plate which cuts a channel while driving into the ground, some means for skewing the plate across the channel is generally required or the plate will be simply pulled back up the channel when the anchor line is tensioned.

Invariably, however, this has required the addition of fixed or moving parts, such as flaps, barbs or flukes, which project from the plate and engage the sides of the channel. Such projections necessarily complicate the structure of the anchor and offer undesirable resistance to the passage of the anchor when driving it into the ground.

The plate also requires some form of socket or locating pin for receiving the driving tool, and this further increases the number of external projections. Correct operation of such plates is often hampered by soil collecting in the hinges associated with the moving parts.

It would therefore be an advantage to provide a ground anchor without any external projections or moving parts, but which is still capable of resisting extraction once it has been driven into the ground.

According to the present invention, there is provided a generally flat anchor plate device folded into a U or V-shape against a resilient bias, means for releasably retaining the anchor plate device in its folded state while driving the plate device into the ground, and means for releasing the retaining means so that the plate device springs open to resist subsequent extraction.

The folded anchor plate device is preferably secured to one end of a flexible anchoring line. In one embodiment, the line incorporates a ground-engaging stop member spaced from the anchor plate device such that, when the anchor reaches a depth which brings the stop member into engagement with the ground, further downward movement of the anchor extends the anchor line and trips the release mechanism.

In one alternative embodiment, the release mechanism is actuated by an independent release line which extends upwardly from the anchor alongside the anchor line.

The anchor line is preferably in the form of a web, strap or tape, which is secured independently to each of the opposed inside faces of the folded U or V-shaped anchor plate.

A driving tool for driving the anchor downwardly into the ground is preferably inserted between the two opposing inside faces of the folded U or V-shaped anchor device and extends upwardly alongside the anchor line. The anchor therefore has a clean, smooth external profile with no projections, hinges or other devices impeding the downward movement of the anchor into the ground. The use of a folded plate also doubles the effective area of the anchor when the plate is sprung open.

The driving tool preferably comprises an elongate shaft attached, for example, to a pneumatic hammer, and terminating in a device having a plurality of driving surfaces for engaging respective portions of the folded anchor device.

The generally flat anchor plate device preferably comprises a single continuous sheet or plate, and the resilient biasing force is preferably provided by a flat plate spring. In one embodiment the anchor sheet or plate itself forms the spring. Alternatively, an independent flat plate spring is secured to the anchor sheet or plate and symmetrically disposed about the fold line. Other forms of spring, such as a leaf spring, can also be used.

The generally flat anchor plate device might alternatively comprise two plates hinged to one another or independently connected to respective inside or outside faces of a flat plate spring folded into a V-shape.

In the accompanying drawings, by way of example only:

Referring to these drawings, a ground anchor system is illustrated in which an anchor plate 10 is secured to one end of a flexible anchor line 11. The line 11 comprises a web or tape consisting of a woven linear composite.

Figure 4:
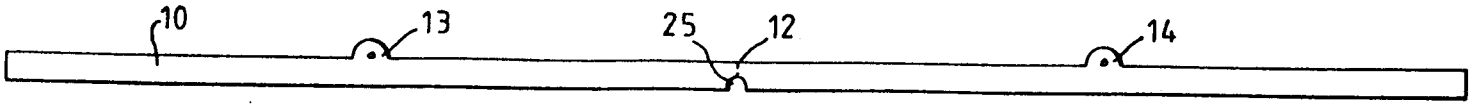
FIG. 4 is a side view of the anchor prior to folding the anchor into its U-shaped configuration.

The rectangular plate 10 is initially flat as shown in FIG. 4 but is then tempered and folded into a U-shaped configuration about a central transverse fold line 12. The plate includes web attachment points 13, 14, one on each of the opposing inside faces of the U-shaped configuration. To assist folding, some metal is preferably removed along the fold line to form a gulley 25 in the underside of the plate.

Figure 5:
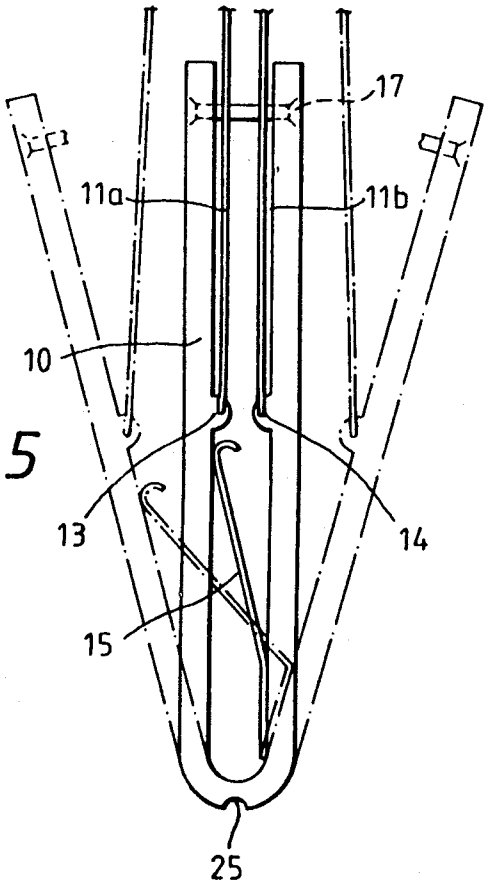
FIG. 5 shows the anchor of FIG. 4 folded into its U-shaped configuration and also shows the anchor line attachments and retaining mechanism.
Figure 6:
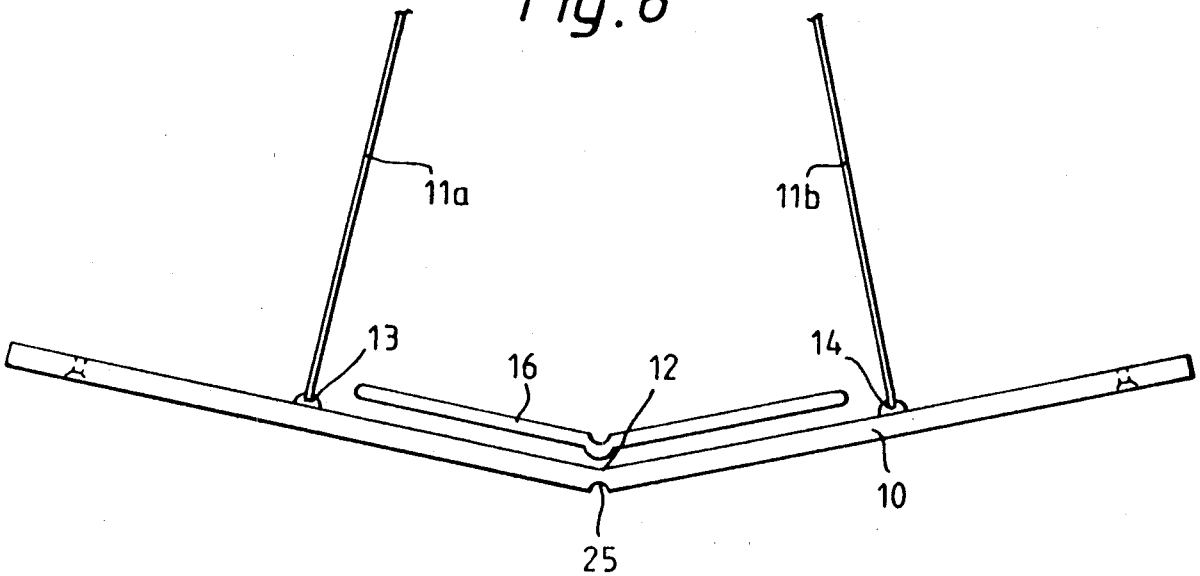
FIG. 6 shows the anchor of FIG. 5 sprung open.
Figure 10:
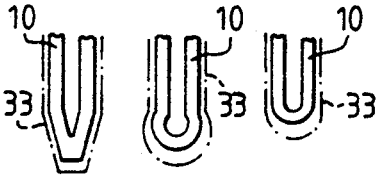
FIG. 10 is a detail showing three alternative configurations for the leading edge of the anchor plate.

The plate 10 is folded into a U-shaped configuration against a resilient bias. FIGS. 5 and 6 illustrate two alternative forms of spring which may be used to provide this bias. FIG. 5 shows a bent leaf spring 15, and FIG. 6 shows a flat plate spring 16. A further alternative would be to form the anchor plate itself as a flat metal spring, and in this case no auxiliary spring mechanism would be required. However, the thickness of the plate would be reduced to provide the necessary resilience, and the plate might be formed, for example, entirely of carbon steel. The leading edge of such a plate is preferably protected by an outer coating of high abrasion resistant synthetic material or by a preformed light metal plate or shield 33 bonded or otherwise secured to the main anchor plate, as shown in the three alternative configurations of FIG. 10.

The plate is retained in its U-shaped configuration against the resilient bias by a shear pin 17 which passes through both sides of the plate and through the web attachment straps 11*a*, 11*b* secured respectively to the attachment points 13 and 14.

Figure 1:
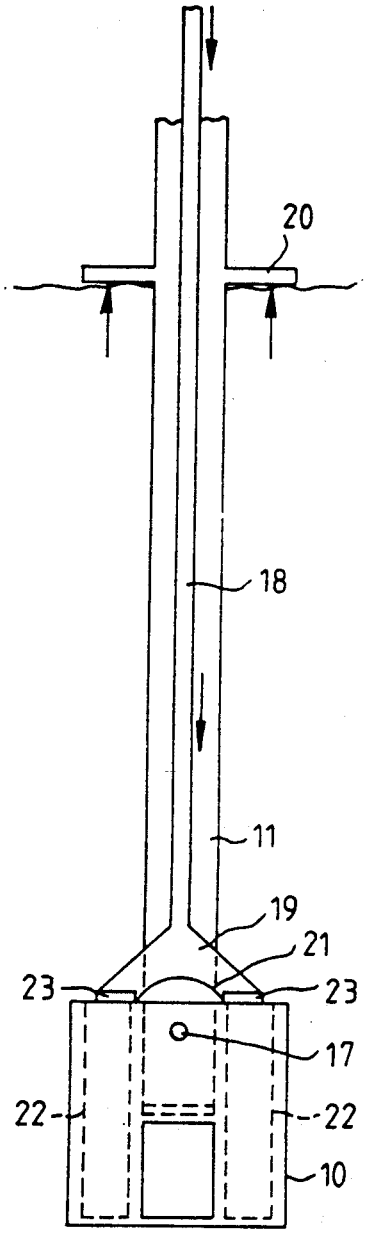
FIG. 1 is a diagrammatic front view of an anchoring system embodying the invention.

A bifurcated end section 19 of a driving tool spigot 18 is inserted into the folded anchor plate 10 and straddles the shear pin 17 as shown in FIG. 1.

The web 11 incorporates an outwardly projecting web stop 20 in the form of a circular disc which prevents the web being driven any further into the ground. Accordingly, when the anchor plate reaches the position shown in FIG. 1, further downward movement of the driving tool 18 to the position shown in FIG. 2 forcibly extends the web 11. As the web stretches, it exerts a force on the shear pin 17 sufficient to shear the pin so that the anchor plate springs into its splayed open position shown in FIGS. 3 and 6 and in dashed outline in FIG. 5. This shearing of the pin 17 preferably occurs against the bridging portion 21 of the bifurcated end section 19 of the driving tool. Accordingly, this bridging portion 21 might be curved oppositely to that shown in FIGS. 1 and 2 so that it curves down below the upper edge of the anchor plate. As the web 11 is stretched between the attachment points 13, 14 and the pin 17, it forces the pin 17 upwardly against this bridging portion 21 of the driving tool to assist the severing action.

Figure 8:
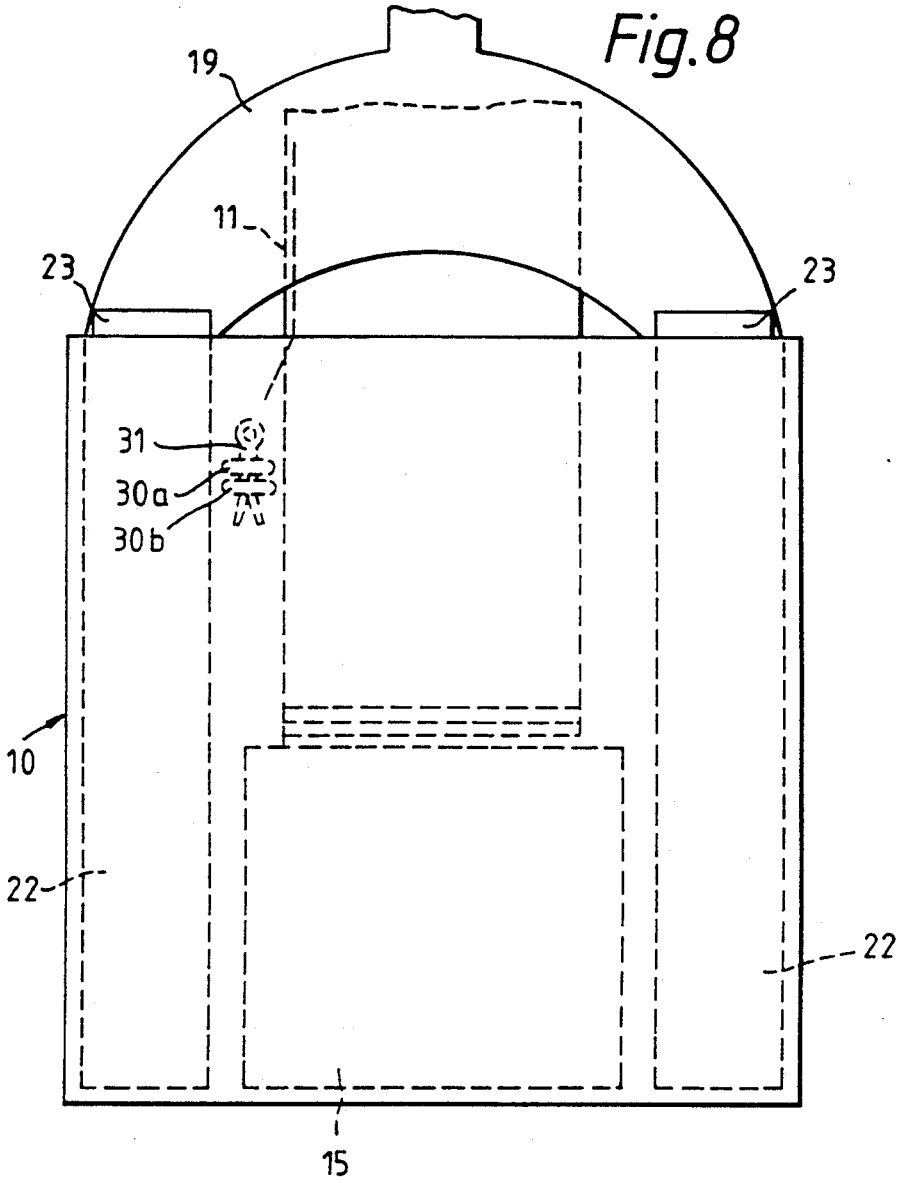
FIG. 8 is a diagrammatic front view similar to FIG. 2 but with an alternative release mechanism.
Figure 9:
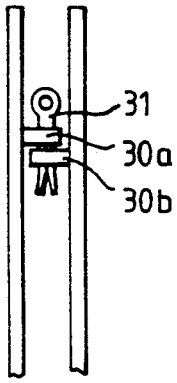
FIG. 9 is a side view of the release mechanism of FIG. 8.

In cases where the anchor line is substantially nonextendible, an alternative form of release mechanism can be used. For example, as shown in FIGS. 8 and 9, in place of the rivet pin 17, the inside opposing faces of the plate 10 may each be provided with a respective horizontal retaining eye 30*a*, 30*b*, the two eyes overlapping one another and the plate being held in its folded U-shaped configuration by a vertical split pin 31 passing through the two eyes. This locking pin may then be connected to a release line 32 which extends upwardly alongside the web 11. When the anchor plate has been driven to the required depth, the release line 32 is pulled to remove the vertical locking pin.

Figure 2:
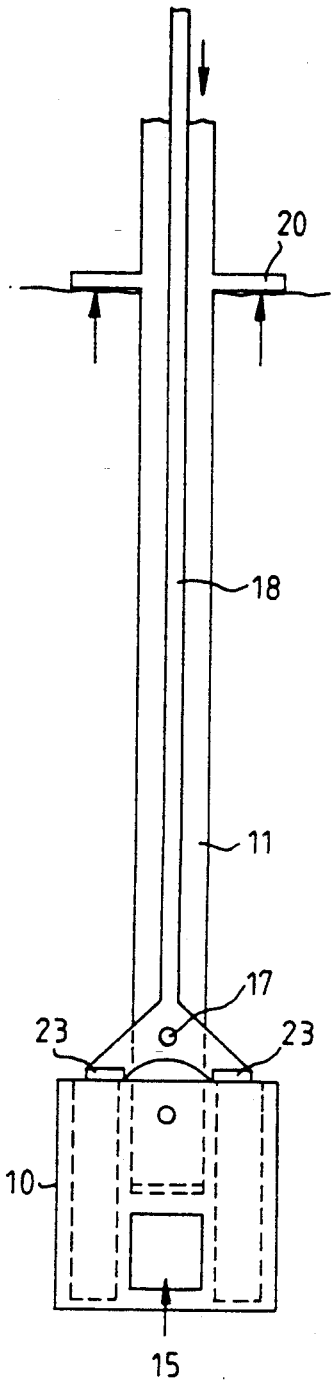
FIG. 2 is a view similar to FIG. 1 showing operation of the release mechanism.
Figure 3:
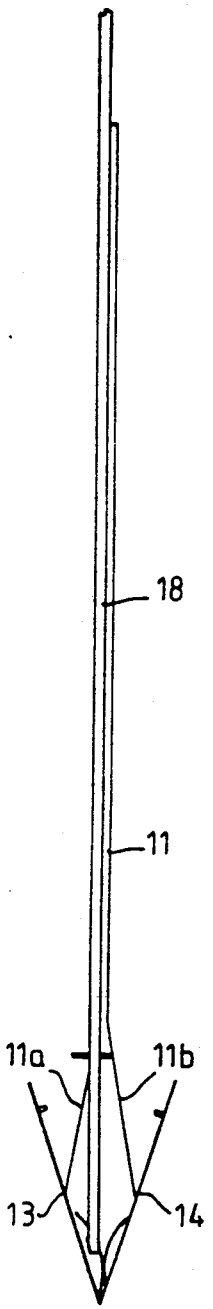
FIG. 3 is a diagrammatic side view showing the anchor in its sprung open, splayed state.

If the release line 32 is secured to the inside face of the web 11, this form of release can also be used with extendible webs, the stretching of the web described in the embodiment of FIG. 2 then tensioning the release line and removing the pin 31.

Figure 7:
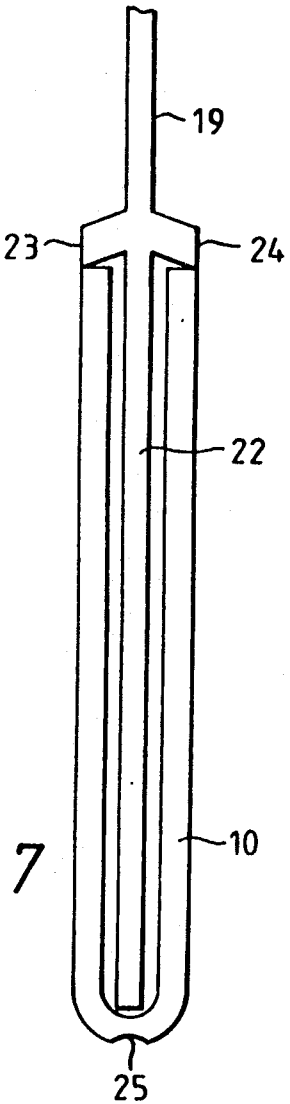
FIG. 7 shows the anchor of FIG. 4 with a driving tool inserted.

As best shown in FIG. 7, each prong 22 of the bifurcated end section 19 of the driving tool carries a pair of opposed shoulders 23, 24 which bear against respective upper edges of the U-shaped plate 10. The prongs 22 help to maintain alignment of the plate while the drive load is spread over the four shoulders 23, 24 and the base of the prongs which also engage the anchor plate along the fold line.

The above described anchor system is particularly suited for use underwater where the anchor plate 10 is driven into a river or sea bed and the driving tool is carried by a diver. The other end of the anchor line might then be secured to a mat of synthetic fronds for creating a permanent consolidated sand bank to prevent scouring of the sea or river bed around support structures.

I claim:

1. A ground anchor adapted to be connected to an end of a flexible anchor line and forcibly driven into the ground, said line being secured to an object being anchored, said ground anchor comprising a generally flat plate device folded into a U or V-shape against a resilient bias, a retaining arrangement connected to folded portions of said folded flat plate device for releasably retaining the plate device in the folded state while driving the anchor into the ground, and a release arrangement connected to the flat plate device for releasing the retaining arrangement so that the plate device springs open to resist subsequent extraction.

2. A ground anchor according to claim 1, wherein the release arrangement is actuated in response to a predetermined length of the anchor line being driven into the ground.

3. A ground anchor according to claim 2, wherein the anchor line is extendible and carries a ground-engaging stop member located such that, when the anchor reaches a depth which brings the stop member into engagement with the ground, further downward movement of the anchor extends the anchor line and trips the release arrangement.

4. A ground anchor according to claim 2, wherein the retaining arrangement includes a shear pin extending through the anchor line.

5. A ground anchor according to claim 1, wherein the release arrangement is actuated by an independent release line which extends upwardly from the plate device alongside the anchor line.

6. A ground anchor according to claim 5, wherein the retaining arrangement includes a locking pin secured at one end of the release line and passing through a linkage between opposing inside faces of the folded portions of the folded flat plate device.

7. A ground anchor according to claim 1, wherein the flat plate device comprises a single generally rectangular sheet transversely folded into the said U or V-shaped configuration.

8. A ground anchor according to claim 7, further comprising an auxiliary spring secured to an inside face of one of the folded portions to provide said resilient bias.

9. A ground anchor according to claim 8, wherein the auxiliary spring is a flat plate spring.

10. A method of anchoring an object to a river or sea bed, comprising securing the object to one end of a flexible anchor line; securing an other end of the flexible anchor line to a generally flat anchor plate device folded into a U or V-shape against a resilient bias; inserting a driving tool between opposing inside faces of the folded anchor plate, releasably retaining the anchor plate in its folded state while driving the plate into the ground, and then releasing the releasably retained anchor plate such that the plate springs open to resist subsequent extraction.

11. A method according to claim 10, further comprising engaging a projecting portion of the driving tool with uppermost edges of the U or V-shaped plate when driving the plate into the ground.

12. A ground anchor adapted to be connected to an end of a flexible anchor line and forcibly driven into the ground, said line being secured to an object being anchored, said anchor device comprising a generally flat plate device folded into a U or V-shape against a resilient bias, said resilient bias enabling folded portions defined by the folded flat plate to spring open after the plate is driven into the ground to resist subsequent extraction.

13. The ground anchor of claim 12, wherein opposed inside faces of the folded portions of the folded flat plate are independently connected to portions of the flexible anchor line at one of said ends.

14. The ground anchor of claim 12, wherein said one end of the flexible anchor line is attached to be driven into the ground together with the folded flat plate.

15. The ground anchor of claim 12, wherein the folded portions of said folded flat plate are connected together along a fold line portion of the folded flat plate which forms the leading edge of the anchor as it is driven into the ground.

* * * * *